US006966099B2

(12) United States Patent
Müller

(10) Patent No.: US 6,966,099 B2
(45) Date of Patent: Nov. 22, 2005

(54) DUSTER NOZZLE FOR VACUUM CLEANERS

(76) Inventor: Hans Müller, Rua 13 de Maio 80, apto. 503, Petrópolis 25685-230, Rio de Janeiro (BR)

( * ) Notice: Subject to any disclaimer, the term of this patent is extended or adjusted under 35 U.S.C. 154(b) by 131 days.

(21) Appl. No.: 10/311,812

(22) PCT Filed: Jun. 22, 2001

(86) PCT No.: PCT/BR01/00080

§ 371 (c)(1),
(2), (4) Date: Jun. 16, 2003

(87) PCT Pub. No.: WO02/00086

PCT Pub. Date: Jan. 3, 2002

(65) Prior Publication Data

US 2004/0020006 A1 Feb. 5, 2004

(30) Foreign Application Priority Data

Jun. 23, 2000 (BR) ..... 0002857

(51) Int. Cl.[7] ..... A47L 9/06
(52) U.S. Cl. ..... 15/393; 15/415.1; 15/422
(58) Field of Search ..... 15/393, 398, 415.1, 15/422, 399

(56) References Cited

U.S. PATENT DOCUMENTS

| | | | | |
|---|---|---|---|---|
| 1,040,176 | A * | 10/1912 | Eichele | 15/399 |
| 2,214,989 | A * | 9/1940 | Brand | 15/399 |
| 2,711,554 | A | 6/1955 | Doyle, Sr. | |
| 2,747,217 | A | 5/1956 | Stahl | |
| 2,814,066 | A | 11/1957 | Lesh, Jr. | |
| 3,259,934 | A | 7/1966 | Leinfelt | |
| 4,972,541 | A | 11/1990 | Smith, Jr. | |
| 5,123,142 | A * | 6/1992 | Miller | 15/393 |
| 6,370,731 | B1 * | 4/2002 | Carter | 15/393 |

FOREIGN PATENT DOCUMENTS

| | | |
|---|---|---|
| DE | 199 01 927 | 7/1999 |
| DE | 199 00 649 | 7/2000 |
| JP | 63130024 | 6/1988 |
| JP | 08182640 | 7/1996 |
| WO | WO-01/00078 | 1/2001 |

OTHER PUBLICATIONS

Copy of International Search report for PCT/BR01/00080 completed Dec. 20, 2001.

* cited by examiner

*Primary Examiner*—Theresa T. Snider
(74) *Attorney, Agent, or Firm*—Alston & Bird LLP

(57) ABSTRACT

The present invention refers to a duster nozzle for vacuum cleaners, comprising a tube (1) carrying a duster (3*a*) at the air flow entrance end. The novelty of the invention basically consists in that the duster (3*a*) has duster elements (3) which decrease in length, at least partially, along the direction that is transverse to the air flow (4) at the entrance end of the nozzle.

8 Claims, 4 Drawing Sheets

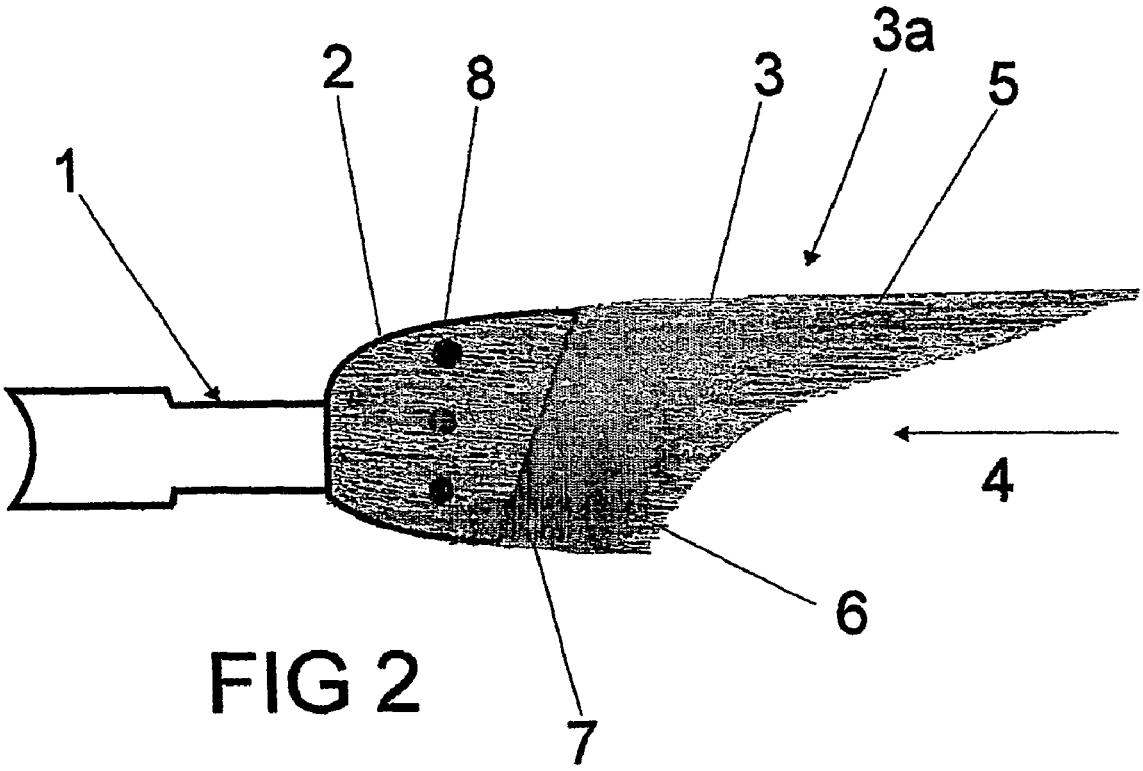
FIG 2
FIG 3
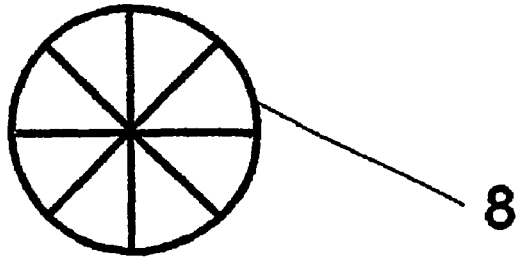

DUSTER NOZZLE FOR VACUUM CLEANERS

TECHNICAL FIELD

The present invention refers to a duster nozzle for vacuum cleaners, that comprises a tube carrying a duster at the air entrance end.

PRIOR ART AND SHORTCOMINGS OF THE PRIOR ART

Duster nozzles for vacuum cleaners are already known in the art.

Figure 1:
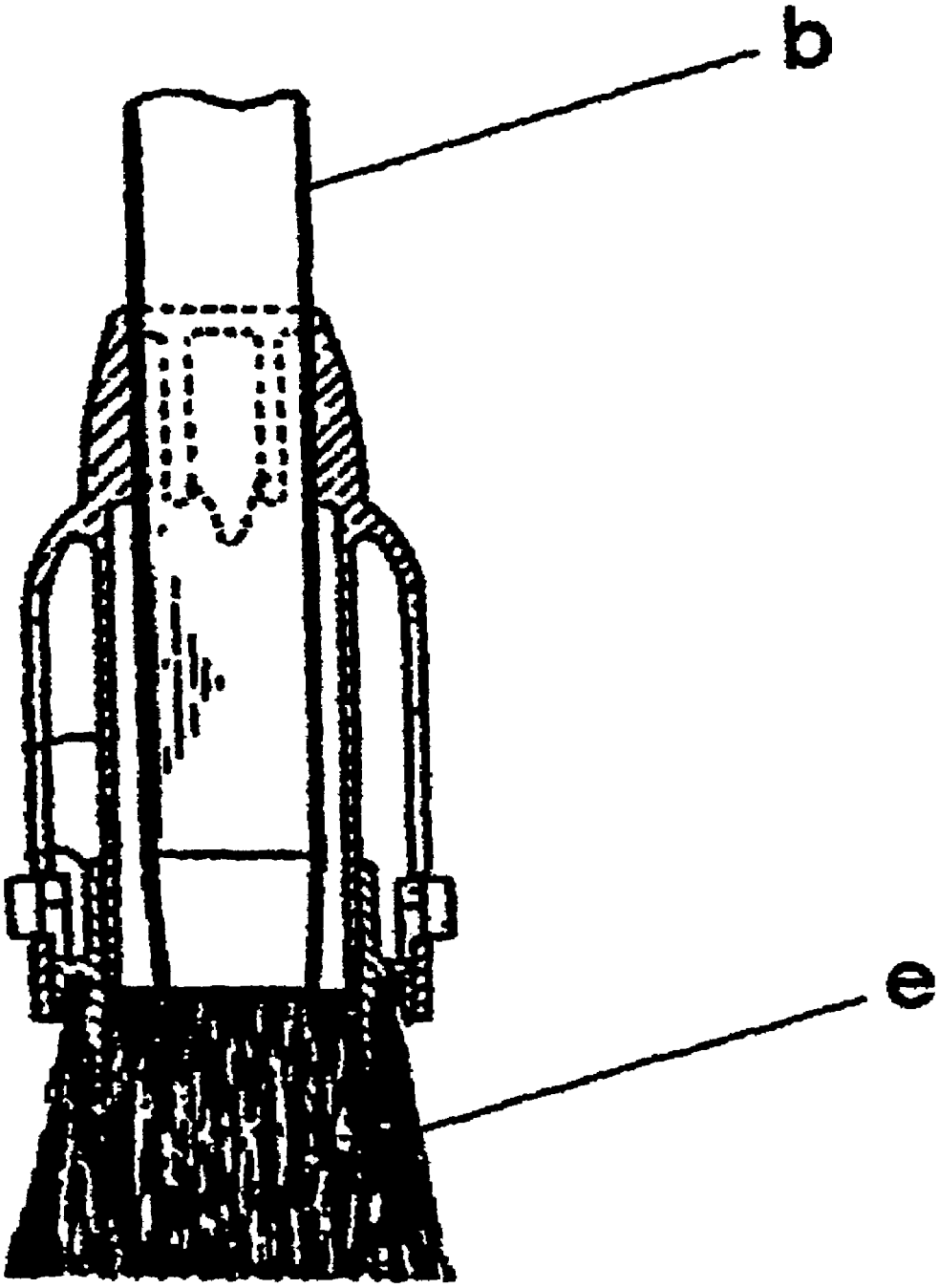
PRIOR ART FIG 1

One example of these already known nozzles is shown in Swiss patent 425112, deposited on Sep. 15, 1964. The following FIG. 1 shows the referenced nozzle, where one can see that the duster "e" is located at the end of the air entrance of tube "b". Therefore, as the nozzle is moved by the user over the floor or furniture surface, the duster removes the dust, which in this form is more easily aspirated by the nozzle.

One inconvenience of the prior art consists of the fact that the known duster nozzles are not appropriate to aspirate the dust from objects that are loose, light, small, fragile or long, for example, objects displayed on store shelves. These nozzles, when utilized, knock over the objects. As a result, the store employee has to hold each object individually in order to aspirate the dust, which in turn causes a great loss of time. This problem is aggravated, particularly in the case of stores with objects that are light, small and present in great quantities, such as, for example, articles of stationary, small decorative objects, jewelry and art objects. In addition, in the case of fragile objects, there also exists the risk of breakage if the employee does not hold each piece individually.

Another inconvenience is that the known nozzles are very difficult to handle during utilization and they scatter too much of the dust, thereby making it necessary to re-aspirate areas where the dust has already been aspirated. In addition, the prior art nozzles do not cover surfaces smoothly and they possess too much dislocation force and suction force.

OBJECTIVES AND ADVANTAGES OF THE INVENTION

The present invention has the objective of providing a duster nozzle: i) that makes it possible to aspirate dust from objects that are fragile, long and light, small, light or loose without the necessity of holding the objects and without the objects being displaced from their positions, ii) that aspirates greater areas with more efficiency, and iii) that has duster elements with increased surface friction and penetration between pieces, without dislocation force.

This objective is achieved by a duster nozzle in which the duster has duster elements which decrease in length, at least partially, along the direction that is transverse to the air flow at the entrance end of the nozzle.

Preferably, the aspiration should be made by pulling and pushing the duster nozzle in favor of, and away from the operator, in small zig-zags, in an oblique position. Transverse, oblique pulling and pushing movements also clean very well. Thus, in the inclined position, the dust is covered first and forced to go under the duster nozzle elements to be aspirated.

The duster nozzle, according to the invention, presents a cone that enlarges in the direction of the air flow entrance end and has, for example, a cylindrical, half-oval or triangular body form. The end of the cone presents, for example, an oblique configuration, or simultaneously oblique and concave.

Thus, by utilizing the duster nozzle in accord with the invention, the feathers or threads slide smoothly over the object to be aspirated at an angle of approximately 40 degrees of inclination, and the aspiration is done with the nozzle in the oblique position with regard to said objects.

The duster nozzle according to the invention provides the following advantages in relation to the already known nozzles:

a) The objects being aspirated receive less weight from the duster elements (feathers or threads) in the oblique configuration, thereby causing less dislocation force on the objects, which continue to maintain their original position. Thus, it is possible to aspirate the dust very rapidly from many small, light, loose, fragile or long and light objects that are displayed on many shelves.

b) An additional advantage is that the duster elements disposed in an oblique configuration cover the objects better. In this manner, the objects receive from the elements, a more prolonged superficial friction and penetration among the pieces, which substantially increases the removal of dust and consequently the efficiency of aspiration.

c) Still another advantage is that the nozzle, with its oblique configuration at the air entrance end, aspirates a proportionately greater area, thereby also increasing the efficiency of aspiration.

d) A further advantage is that the duster nozzle according to the invention, also makes it possible to aspirate the dust from pieces containing loose bands, cables, wires or complicated tubular structures, without causing any inconvenience.

The cone of the duster nozzle in the present invention, presents an internal retention net that functions to prevent the aspiration of the duster elements and small objects. The duster elements can be fixed externally or internally to said cone and they project themselves in an oblique formation along side of the surface of the cone and beyond the end of said cone.

The elements of the duster can be, for example, animal or artificial feathers, cotton threads, vegetal fiber threads, or artificial fiber threads. When feathers are used, the plumes of each feather are disposed in such a way that the diameter of the transversal section of the feather decreases from the distal end of the feather to the end joined to the duster nozzle.

DETAILED DESCRIPTION OF THE INVENTION

The invention will now be described in more detail, for example, based on the attached figures.

Figure 4:
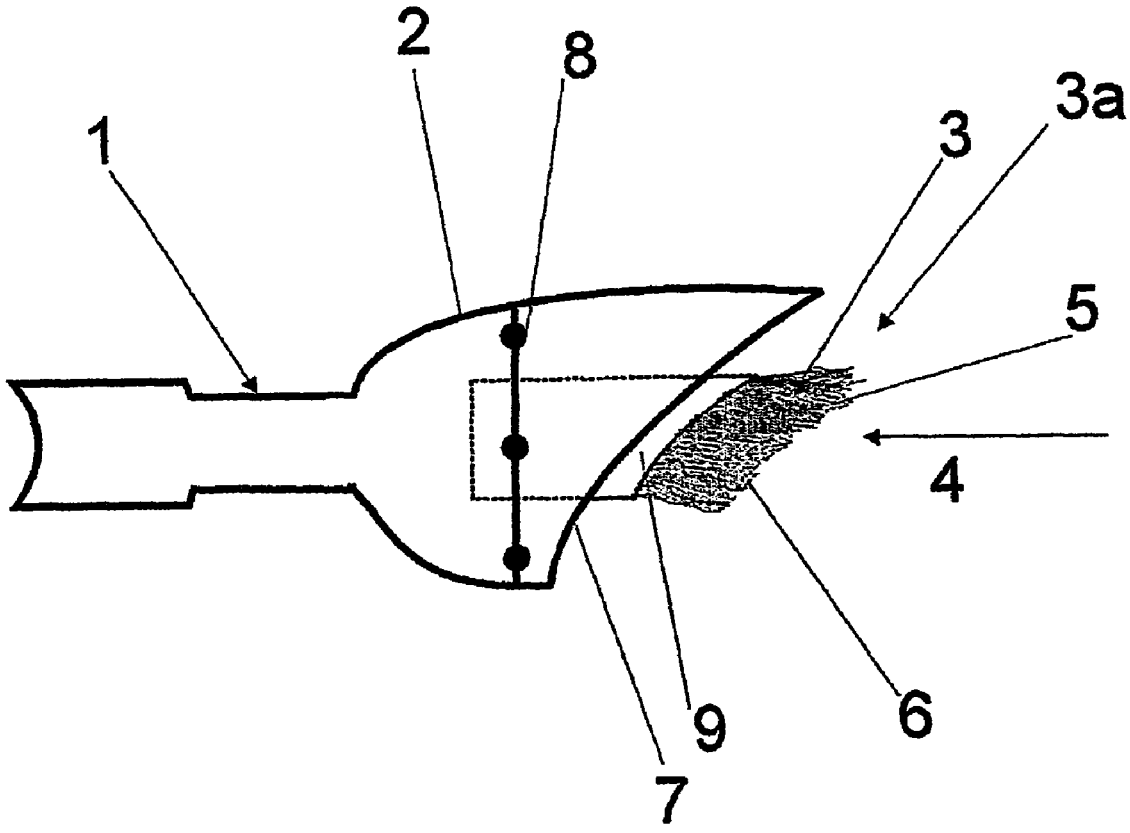
Figure 5:
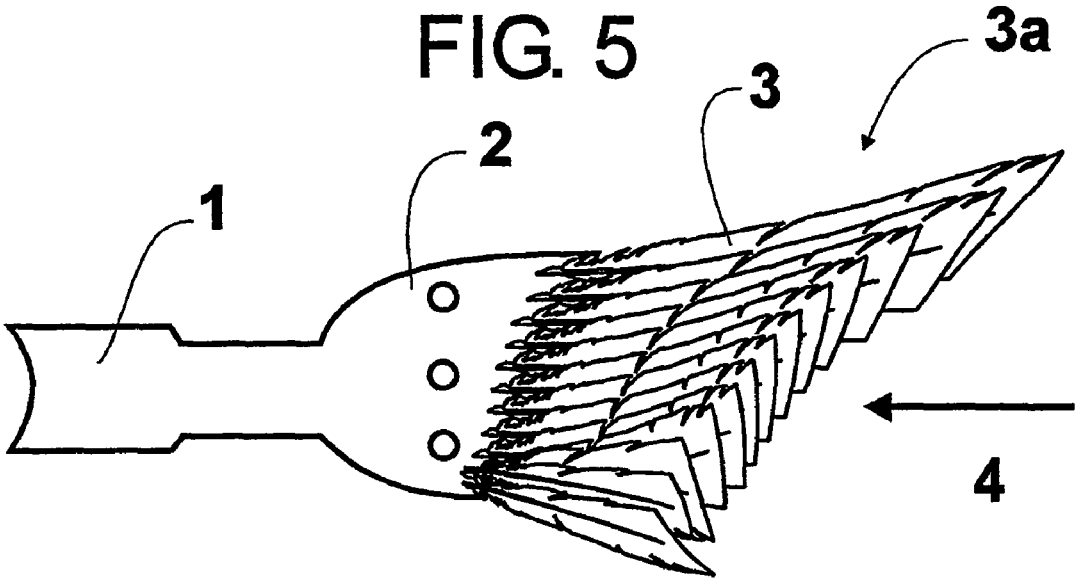
Figure 6:
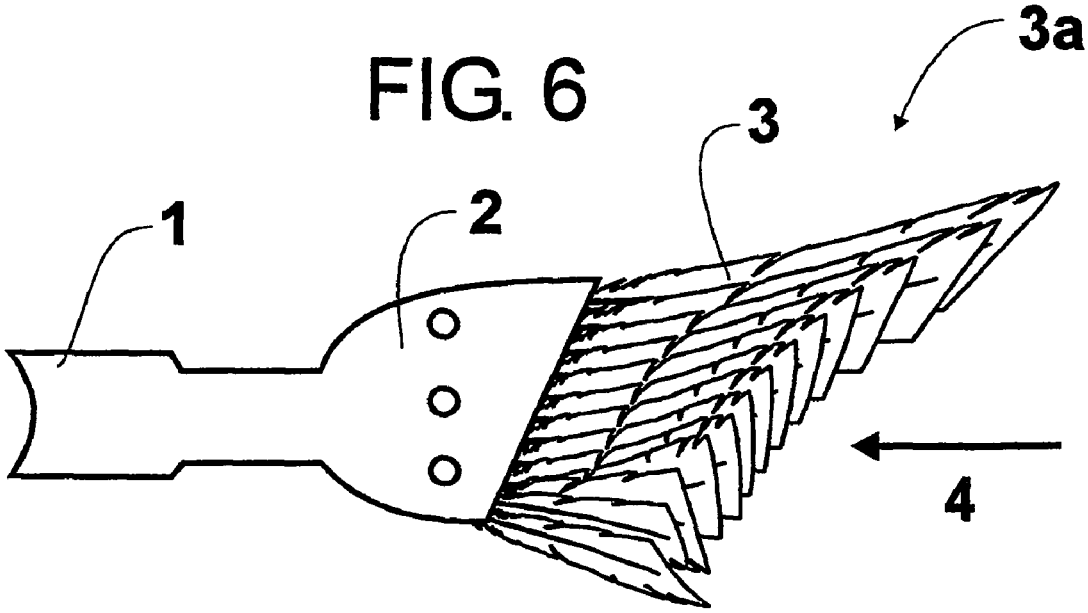

FIG. 1 - a section view of a duster nozzle of the prior art;

FIG. 2 - a side view of a first embodiment of a duster nozzle according to the invention;

FIG. 3 - a front view of an embodiment of a duster element retention net;

FIG. 4 - a side view of a second embodiment of the duster nozzle according to the invention;

FIG. 5 - a side view of a third embodiment of the duster nozzle according to the invention; and FIG. 6 - a side view of a fourth embodiment of the duster nozzle according to the invention.

FIG. 2 shows the side view of a first embodiment of the duster nozzle according to the invention, where it is observed that said nozzle comprises a tube 1 which becomes larger towards the air flow entrance end, thereby forming a cone 2. Elements 3 of a duster 3*a* are fixed externally around the cone 2 and present decreasing lengths in the direction that is transverse to the air flow 4 from the nozzle's entrance, i.e., decrease obliquely. In the present figure, it can be observed that the duster elements with longer length 5 are situated at the upper region of the cone 2, while the shorter elements 6 are at the lower region of the cone 2. The cone 2 presents an end 7 with an oblique configuration, and carries within its interior a retention net 8 that blocks the aspiration of small objects. Elements 3 of the duster 3*a* have a certain rigidity that prevents the feathers or threads from curving into the cone when in use.

FIG. 3 shows a front view of the retention net 8 shown in FIG. 2. In this embodiment, the retention is represented by a crossed ring.

FIG. 4 shows the side view of a second embodiment of a duster nozzle in accord with the invention, which basically presents the same components shown in FIG. 2. This embodiment is different from the first embodiment because of the fact that the duster elements 3 are disposed internally within the cone 2, and the end 7 of the cone 2 presents a configuration that is simultaneously oblique and concave. In this embodiment, the elements 3 are fixed at the base 9, in which the retention ring 8 is also fixed.

FIGS. 5 and 6 show the side view of third and fourth embodiments of a duster nozzle in accord with the invention, which basically present the same components shown in FIG. 2, wherein the duster elements 3 are feathers. In FIG. 5 the feathers are disposed externally around the cone 2 and in FIG. 6 they are disposed internally within the cone 2.

Besides the embodiments presented before, the inventive concept can be applied to other alternatives or possibilities of inventive utilization.

For example, i) the tube 1 and the cone 2, besides including a cylindrical transverse section, can also have a transverse section that is squared, rectangular, elliptical, hexagonal, triangular or semi-circular; ii) the tube 1 can also be curved or in an "L" configuration; iii) the retention net 8 can be made of a plain wire material, or of a screen in the form of a cone 2; iv) the elements 3 in the embodiment shown in FIG. 4, can be fixed directly on the internal surface of the wall of the cone 2 and in this case, the base 9 becomes expendable; and v) the cone 2 can have a triangular, half-oval or other body form.

Therefore, it will be understood that the present invention should be interpreted in a broad manner, its breadth being determined only by the terms of the claims.

What is claimed is:

1. A duster nozzle for vacuum cleaners, comprising:

a tube having an air flow entrance end;

a cone affixed to the tube at the air flow entrance end, the cone having a distal end and an opposite end affixed to the tube;

a duster affixed to the cone at the air flow entrance end, the duster comprising a plurality of feathers which decrease in length along a transverse direction that is transverse to the air flow at the air flow entrance end, the feathers being arranged such that an outer end of the duster has an oblique configuration having an inclination angle of about 40° relative to the transverse direction, and wherein the distal end of the cone also has an oblique configuration.

2. The duster nozzle in accord with claim 1, wherein the cone becomes larger in diameter in a direction opposite to the direction of the air flow through the cone.

3. The duster nozzle in accord with claim 1, wherein the cone has a cylindrical, half-oval or triangular body form.

4. The duster nozzle in accord with claim 1, wherein the distal end of the cone has an oblique and concave configuration.

5. The duster nozzle in accord with claim 1, wherein the cone has a retention net disposed within the cone and structured and arranged to prevent the aspiration of duster elements and small objects.

6. The duster nozzle in accord with claim 1, wherein the feathers are externally fixed to the cone and extend in an oblique formation along an outside surface of the cone and beyond the distal end of said cone.

7. The duster nozzle in accord with claim 1, wherein the feathers are externally fixed to the cone and extend in an oblique formation along an inside surface of the cone and beyond the distal end of said cone.

8. The duster nozzle in accord with claim 1, wherein the feathers are disposed in such a way that the diameter of the transversal section of each feather decreases from a distal end of the feather to the end joined to the cone.

* * * * *